United States Patent [19]

Von Kohorn

[11] 4,348,056

[45] Sep. 7, 1982

[54] METHOD FOR ABOVE-GROUND LEACHING OF METAL BEARING ORES AT BELOW-FREEZING TEMPERATURES

[76] Inventor: Henry Von Kohorn, 22 Perkins Rd., Greenwich, Conn. 06830

[21] Appl. No.: 224,651

[22] Filed: Jan. 12, 1981

[51] Int. Cl.[3] ..... E21B 43/28

[52] U.S. Cl. ..... 299/4; 75/101 R; 166/DIG. 1

[58] Field of Search ..... 299/4, 5; 166/DIG. 1; 405/130, 131; 75/101 R; 414/133

[56] References Cited

U.S. PATENT DOCUMENTS 3,510,169 5/1970 Moss ..... 299/7

4,247,331 1/1981 Hamlin et al. ..... 414/133 X

OTHER PUBLICATIONS

Heap Leaching of Uranium, A Case History Mining Engineering, Mar. 1978, pp. 285–290.

*Primary Examiner*—Ernest R. Purser

[57] ABSTRACT

Disclosed is a method permitting above-ground heap leaching of metal bearing ores in below-freezing temperatures by utilizing one or more insulating layers deposited on the principal ore body to be leached. One of said layers is an insulating ore layer covering multiple leach liquor outlets positioned above said principal ore body. Other insulating layers may be comprised of a flexible sheet and a crust of frozen leach liquor.

9 Claims, No Drawings

METHOD FOR ABOVE-GROUND LEACHING OF METAL BEARING ORES AT BELOW-FREEZING TEMPERATURES

BACKGROUND OF THE DISCLOSURE

The present invention relates to the year-round extraction of precious and other metals from crushed ore by above-ground heap leaching.

At present, where such heap leaching facilities are located in areas where the temperature drops below the freezing point of the leach liquor, leaching operations must be discontinued for extended periods during cold weather, because the freezing of the leach liquor in the upper part of the ore body or leach pile creates an impermeable layer or crust which prevents the leach liquor from percolating downward.

SUMMARY OF THE INVENTION

According to the present invention, one or more insulating layers of the types described hereinafter are provided on or in close proximity to the upper surface of the principal ore body or pile to be leached. Such layer or layers serve to insulate the leach liquor discharged into the principal ore body to be leached from the below-freezing temperatures of the atmosphere. The term "below-freezing" temperatures refers to prevailing local atmospheric temperatures below the freezing point of the specific leach liquor employed. Leach liquor is introduced between said principal ore body and said second insulating layer, thus preventing it from freezing.

Accordingly, it is an object of the present invention to permit year-round leaching of above-ground ore bodies in below-freezing atmospheric temperatures, thereby significantly increasing the annual extraction of metals.

DETAILED DESCRIPTION OF THE INVENTION

An ore body or pile is constructed on a leach pad in accordance with customary practice. Supply and piping means for the leach liquor are provided. Permanent distributing outlets connected to the leach liquor piping means are provided, said outlets resting on or being positioned in close proximity to the upper surface of the leach pipe; they are hereinafter sometimes referred to as first leach liquor outlets. The outlets may be pipes or pipe branches having perforations, or other liquid distributing means; normally, they wil not have any external moving parts. In addition to said permanent distributing means, removable sprinklers may be provided and used during above-freezing weather. Prior to the onset of below-freezing weather, if sprinklers with moving parts have been used, they are removed and may be replaced with perforated pipes or a plurality of other types of branch outlets. According to a preferred embodiment, the perforated tubes or pipes rest horizontally directly on the upper surface of the first ore pile.

A second, substantially thinner layer of ore is then deposited on the thicker first layer, that is the principal ore body to be leached. This second layer is an insulating layer and may consist of crushed ore identical to or different from the ore forming the first ore body. But the second layer must be thick enough to cover the leach liquor outlets above the first ore layer. The minimum depth or thickness of the second ore layer must be determined empirically in accordance with temperature conditions and the insulating capacity of the ore, but must, in any event, be such as to prevent the leach liquor discharged from said first leach liquor outlets into the principal ore body from freezing.

When the second, upper layer of ore is of such nature and thickness as to substantially prevent outside air from entering the first ore body, air may be introduced into the leach liquor piping system, so as to deliver aerated leach liquor to the ore body to be leached. Alternatively, when required by the leaching process such as cyanidation, air can be supplied through a plurality of pipe outlets directly to and into the first ore body.

According to a preferred embodiment of the invention, sprinklers are installed above the second insulating ore layer and may also be supplied through the aforementioned leach liquor supply and piping system.

These sprinklers are not used during below-freezing temperatures, except as set forth below. During below-freezing temperatures the said sprinklers above the insulating layer may be used for short periods of time for the specific purpose of causing the leach liquor at least in the upper reaches of the insulating ore layer to freeze and form a crust which further insulates the principal first ore body from the atmospheric temperatures. Instead of sprinklers, other suitable distributing outlets may be utilized; such sprinklers or other outlets are hereinafter sometimes referred to as second leach liquor outlets.

According to yet another embodiment, before installing the first, permanent leach liquor outlets near the upper surface of the principal first ore body, and before depositing the second ore layer on the first ore body, a man-made sheet, which may be flexible, such as a plastic film, is spread over all or most of the upper surface of the principal first ore body. The said sheet has perforations permitting the leach liquor to pass through it and to percolate downward through the crushed ore. The number, size and configuration of the perforations are determined empirically and chosen so as to insure good distribution of the leach liquor deposited on said sheet by the perforated pipes or other form of multiple distribution outlets. The said perforated pipes or other outlet means may rest directly on said plastic sheet, the plastic sheet in turn resting directly on the first principal ore layer. In such event a dual insulating effect of the plastic sheet and the second, upper ore layer is created.

When cyanidation leaching is used, the leach liquor may be aerated to aid the cyanidation process. Alternatively, the leach liquor piping and the buried first leach liquor outlets may be utilized to introduce only air into the first ore body; in such an event, the flow of leach liquor is interrupted for a limited time and then resumed.

The following examples will further define various embodiments of the present invention:

EXAMPLE I

A four meter high ore layer, that is the principal leach pile, is constructed on a leach pad and is comprised of gold bearing ore crushed to approximately three centimeter size. During clement weather, this first ore body is leached by sprinkling or otherwise discharging a sodium cyanide solution on the ore according to known methods. Prior to the onset of temperatures below zero degrees centigrade, if sprinklers have been used, they are replaced with a plurality of other, permanent leach liquor outlets, such as a plurality of closely spaced perforated pipes resting horizontally on the upper surface of said first ore body. The pipes may be perforated plastic tubing having an inside diameter of two centimeters, a wall thickness of three millimeters and being spaced 20 centimeters apart. A second ore layer is then deposited on the first ore body, the added layer being one meter thick and covering the perforated pipes or other outlets. Leaching of the principal ore body is then continued through said first outlets between the first ore body and the contiguous second ore layer. Pregnant leach liquor is collected at the bottom of the leach pile and the dissolved gold is recovered by known methods.

EXAMPLE II

The steps of Example I are followed with the following modifications. When atmospheric temperatures are above the freezing point of the leach liquor, sprinklers are installed above the second, upper ore layer and leaching of both the first and second ore bodies is achieved by letting the leach liquor percolate through the two contiguous ore bodies according to common leaching practice. Additional leach liquor may continue to be introduced into the first ore body through the first leach liquor outlets, such as perforated pipes, which remain in place between the first and second ore bodies. If the volume of leach liquor introduced through the second outlets is sufficient, the use of the first outlets may be discontinued. Their continued use has the advantage however, of introducing additional volume of barren leach liquor into the combined ore bodies. When the weather turns cold, the second outlets above the second, upper layer are shut down and only the principal first ore body is leached by the leach liquor introduced through the first permanent outlets between the two ore bodies.

The second outlets may, however, be used long enough during below-freezing weather to bring about the formation of an insulating layer or crust of frozen leach liquor in the upper part of the second insulating ore layer.

EXAMPLE III

The steps of Examples I or II are followed with the following modifications. Before providing the first step of multiple leach liquor outlets resting on or in close proximity to the upper surface of the principal ore body, and before depositing the second ore layer, a cyanide resisting plastic sheet is placed on the upper surface of the first ore body. The flexible plastic film has a thickness of three millimeters and has circular perforations of one centimeter diameter spaced five centimeters apart. The film further aids in the uniform distribution of the leach liquor throughout the first principal ore body. It also permits using fewer or less closely spaced first leach liquor outlets. The said film remains in place throughout the leach cycle. To aid cyanidation, air is forced into the leach liquor supply pipes, or directly into the first ore body.

It should be understood that according to the present invention not only the first, principal ore body may be leached throughout the year, but the second, insulating ore layer may also be leached during above-freezing atmospheric temperatures.

When an insulating crust has been formed in the upper reaches of the second, insulating ore layer and when the heretofore mentioned flexible sheet is used, a triple insulating effect is secured.

Assuming a four meter thick principal ore body and a similar, second, one meter thick insulating ore layer, and further assuming eight months per year of above-freezing temperatures and four months per year of below-freezing temperatures, the extraction of metal from the combined five meter ore body achieved heretofore is $\frac{2}{3}$ or 10/15 of the theoretical, full annual extraction; whereas by utilizing the present method, the annual metal extraction under the same temperature conditions is increased to 14/15, equal to a 40 percent increase in time utilization.

While specific components of the present system are defined in the working examples above, any other appropriate materials may be substituted. In addition, other variables may be introduced into the present method which may affect or improve said method. While variations are given in the present application, other modifications and ramifications will occur to those skilled in the art upon reading the present disclosure; these are intended to be included herein.

What is claimed is:

1. A method for above-ground leaching of metal bearing ores in below-freezing atmospheric temperatures which comprises (a) constructing a first ore body, (b) providing leach liquor supply and piping means, (c) providing above and in close proximity to the upper surface of said first ore body a plurality of leach liquor outlets, (d) depositing on said upper ore surface a second insulating ore layer of such thickness as to cover said leach liquor outlets to a depth sufficient to prevent freezing at prevailing below-freezing atmospheric temperatures of the leach liquor discharged into the first ore body through said outlets, and (e) introducing leach liquor into the first ore body through said leach liquor outlets.

2. The method of claim 1, comprising providing a corrosion resisting perforated man-made sheet between the first ore body and the second ore layer.

3. The method of claim 1, wherein air is introduced into the first ore body.

4. The method of claim 1, wherein the leach liquor has been aerated.

5. A method for the year-round above-ground leaching of metal bearing ores which comprises (a) constructing a first ore body, (b) providing leach liquor supply and piping means, (c) providing above and in close proximity to the upper surface of said first ore body a plurality of first leach liquor outlets, (d) depositing on said upper surface a second insulating ore layer of such thickness as to cover said first leach liquor outlets to a depth sufficient to prevent freezing at prevailing below-freezing atmospheric temperatures of the leach liquor discharged into the first ore body through said first leach liquor outlets, (e) providing above the upper surface of the second insulating ore layer a plurality of second leach liquor outlets, (f) discharging leach liquor through said second leach liquor outlets onto the upper surface of the second ore layer during above-freezing atmospheric temperatures, and (g) introducing leach liquor into the first ore body through said first leach liquor outlets at least during below-freezing atmospheric temperatures.

6. The method of claim 4, comprising providing a corrosion resisting perforated man-made sheet between the first ore body and the second ore layer.

7. The method of claim 5, wherein air is introduced into the first ore body.

8. The method of claim 5, wherein the leach liquor has been aerated.

9. The method of claim 5, wherein sufficient leach liquor is deposited on the upper surface of the second ore layer during below-freezing temperatures for a length of time sufficient to cause the formation of an insulating layer of frozen leach liquor in the upper part of the second ore layer.

* * * * *